US005250310A

United States Patent [19]

Fujino et al.

[11] Patent Number: 5,250,310

[45] Date of Patent: Oct. 5, 1993

[54] METHOD FOR PACKING AND STORING MEAT

[75] Inventors: Seizo Fujino, Tokyo; Hidenori Yoshizawa, Ibaragi; Yoshio Hirose, Tokyo, all of Japan

[73] Assignee: Japan Vilene Company, Ltd., Tokyo, Japan

[21] Appl. No.: 807,967

[22] Filed: Dec. 11, 1991

Related U.S. Application Data

[63] Continuation of Ser. No. 604,943, Oct. 29, 1990, abandoned.

[30] Foreign Application Priority Data

Nov. 2, 1989 [JP] Japan ..... 1-287193

[51] Int. Cl.[5] ..... B65B 55/00

[52] U.S. Cl. ..... 426/124; 426/127; 426/129; 426/392; 426/396

[58] Field of Search ..... 426/124, 127, 129, 396, 426/392

[56] References Cited

U.S. PATENT DOCUMENTS 2,707,289 5/1955 Taggart ..... 428/535
3,823,057 7/1994 Roberts et al. ..... 428/535
4,017,653 4/1977 Gross ..... 427/386
4,410,578 10/1983 Miller ..... 426/124
4,414,255 11/1983 Tokuyama et al. ..... 428/535
4,615,923 10/1986 Marx ..... 426/124
4,715,918 12/1987 Lang ..... 156/273.1
4,935,276 6/1990 Pawlowski et al. ..... 426/124
4,935,282 6/1990 Pawlowski et al. ..... 426/124

FOREIGN PATENT DOCUMENTS 1034734 4/1987 Japan ..... 428/513

*Primary Examiner*—Helen F. Pratt
*Attorney, Agent, or Firm*—John Lezdey

[57] ABSTRACT

A method for packaging meat in a gas impermeable film which comprises providing a liquid absorbing insert formed by a water absorbing material between a sheet of a liquid impermeable material and a layer of liquid permeable material, placing the meat so as to face the liquid impermeable sheet, wrapping a gas impermeable sheet about the meat and liquid absorbing insert, and then providing a vacuum so as to form a capillary action at spaces between the meat and the liquid permeable sheet.

8 Claims, 2 Drawing Sheets

METHOD FOR PACKING AND STORING MEAT

This is a continuation-in-part of application Ser. No. 604,943, filed Oct. 29, 1990 now abandoned.

FIELD OF THE INVENTION

The present invention relates to methods for packing and storing meat such as beef and pork and a package thereof. More particularly, the invention provides methods for packing and storing meat and a package thereof in which quality deterioration, decrease of commodity profit rate, and overabsorption of juice of the meat can be prevented by absorbing and removing the juice transuding or originating from the meat.

BACKGROUND OF THE INVENTION

In general, juice transuding from meat (which hereinafter will be called "extra juice") is one of the reasons for lowering the commodity value of the meat.

Additionally, a part of the meat becomes discolored in contact with the extra juice and the discolored portion has to be removed, so that it causes a lowering of the commodity profit rate. Moreover, the term of storing the meat becomes shorter because the above juice tends to propagate generally active bacteria therein.

A method for packing crustacean for the purpose of removing the extra juice which causes the above various problems is proposed in Japanese Laid-Open Patent Publication No. 63-71145. However, in this method, when temporal or continuous pressure is applied to a liquid absorbing member which has absorbed the extra juice. the absorbed juice transudes from the surface of this member. Accordingly, it is difficult to decrease the time of contact between the extra juice and the food, particularly, in the case of storing the meat which is not covered with a shell. This proposed method is not sufficient for resolving the aforementioned problems.

A method for storing meat is disclosed in Japanese Patent Application No. 1-153159 filed on Jun. 15, 1989 of Fujino et al.

According to the method proposed in Japanese Patent Application No. 1-153159, the efficiency of the extra juice absorption is improved over the method disclosed in the laid-open publication No. 63-71147 by arranging a liquid permeable sheet in contact with the meat. However, it is already anticipated that the absorption sheet will also absorb necessary juices besides the extra juice in the meat according to the method in Japanese Patent Application No. 1-153159. It is well known that the juice plays an important role in deciding a flavor of the meat, and losing the necessary juice will bring about lowering of the commodity value of the meat. Accordingly, in order to prevent overabsorption of the juice, it has been necessary to predetermine an amount of the transuding juice during its storing term and, according to this predetermination, to adjust the amount or speed of the liquid absorption.

However, the amount and speed of the juice transuding from the meat are varied according to sizes and shapes of the meat and to its storing conditions. Therefore, it is difficult to comprehend the amount and speed of the transuding extra juice, and high technique necessary to store the meat in stable conditions while keeping its commodity value high.

The present invention is directed to solving the above problems, and the problems regarding quality deterioration of the commodity, decrease of commodity profit rate, and overabsorption of the juice inside the meat.

An object of the present invention is to provide methods for packing and storing meat and a package thereof which can prevent the quality deterioration of the commodity, the decrease of commodity profit rate, and the overabsorption of the juice by absorbing and also to removing the juice transuding from the meat.

SUMMARY OF THE INVENTION

The present invention relates to a method for packing meat characterized by the fact that a packaging insert comprising a liquid absorbing insert is formed by having an absorber between a liquid permeable layer and a liquid impermeable sheet is arranged so as to have the liquid impermeable sheet facing the meat, and that said liquid absorber and said meat are vacuum-packed in a gas impermeable film so as to make juice which transudes from the meat absorbed through the liquid permeable layer of said liquid absorber.

The invention further provides a method for storing meat characterized by the meat being packed in the packing method which utilizes refrigeration.

Advantageously, the packaging used in the packing method comprises at least a gas impermeable film for vacuum-packing the meat, and an insert comprising a liquid absorber between a liquid permeable layer facing said gas impermeable film and a liquid impermeable sheet facing said meat.

According to the method of the invention, a capillary phenomenon occurs at spaces between the meat and the liquid impermeable sheet, between the gas impermeable film and the meat, and between the gas impermeable sheet and the liquid permeable layer respectively. Accordingly, the extra juice transuding from the meat reaches the liquid permeable layer because of this capillary phenomenon. Consequently, only the extra juice transuding from the meat is absorbed by the absorber via the above liquid permeable layer by applying the method of the present invention.

DESCRIPTION OF THE PREFERRED EMBODIMENT

Figure 1:
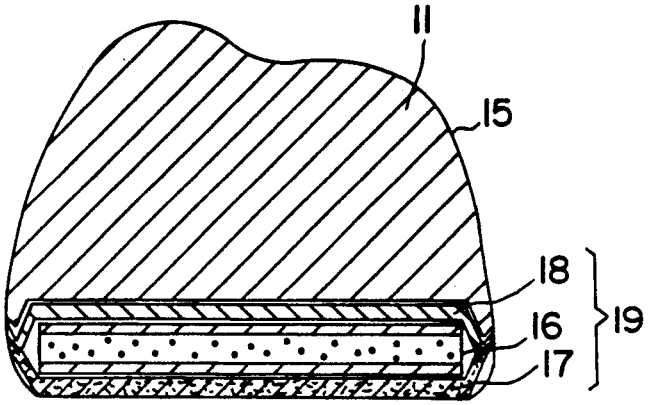
FIG. 1 is an enlarged diagrammatic cross-sectional view showing a package of the invention.

Method for packing and storing meat and its package of the present invention are now explained in details hereinafter according to one embodiment illustrated in the drawings.

Figure 2:
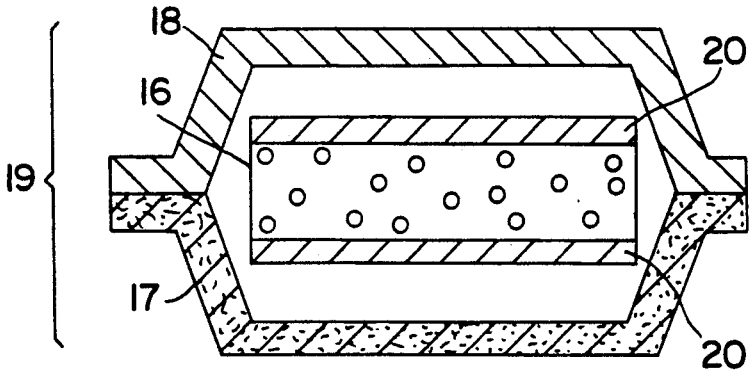
FIG. 2 is an enlarged cross-sectional view of a liquid absorber.
Figure 3:
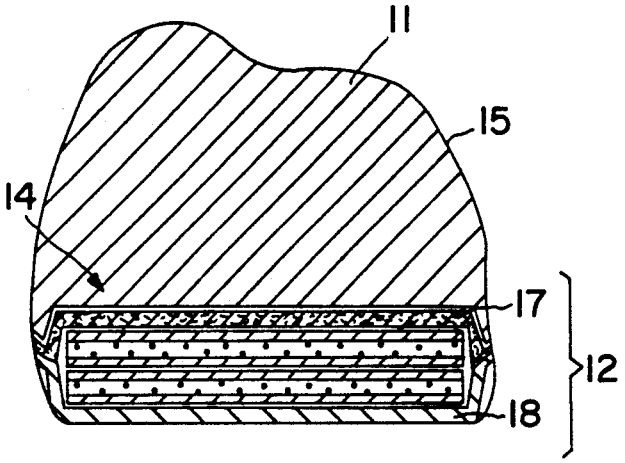
FIG. 3 is an enlarged cross-sectional view of a prior art package.

As seen in FIGS. 1 and 2, a liquid absorbing insert 19 is provided by having a liquid absorber 16 between a liquid permeable sheet or layer 17 and a liquid impermeable sheet 18 and arranged so as to make the liquid impermeable sheet 18 facing the meat 11.

The meat 11 and the above mentioned liquid absorbing insert 19 are vacuum-packed in a gas impermeable film 15 so as to make juice which transudes from the meat 11 absorbed through the liquid permeable sheet or layer 17 of the insert 19.

In the present invention, the packaging insert liquid absorbing insert 19 comprises the liquid permeable layer 17, the liquid impermeable sheet 18, and the liquid absorber 16 which held between the layer 17 and sheet 18. The above liquid absorbing insert 19 is arranged on the meat so as to make the liquid impermeable sheet 18 face the meat which can take various shapes such as a block shape shown in FIG. 1, a thinly sliced shape, and others. Accordingly, the meat 11 does not contact the liquid permeable layer 17 of the liquid absorbing insert 19 directly, so that there is no such problem as the flavor of the meat is deteriorated because of forced absorption of the necessary juice inside the meat into the liquid absorbing insert.

The meat 11 and the liquid impermeable sheet 18 of the liquid absorbing insert 19 are usually arranged in contact with each other, but if necessary, a liquid permeable member (not shown in the drawings) such as paper or the like can be also provided between the meat 11 and the liquid impermeable sheet 18. It may be the case, for example, that the meat wrapped in paper is vacuum-packed together with the liquid absorber in the gas impermeable film.

In the state already discussed, the meat 11 and the liquid absorbing insert 19 are vacuum-packed in the gas impermeable film 15, so that capillary phenomenon occurs at spaces between the meat 11 and the liquid impermeable sheet 16, between the meat 11 and the gas impermeable film 15, and between the liquid permeable sheet or layer 17 and the gas impermeable film 15 respectively. Therefore, the extra juice transuding from the meat 11 is moved and diffused along a meat side surface of the gas impermeable film 15, and is absorbed by the insert 19 after reaching the liquid permeable sheet or layer 17.

A degree of vacuum of about 450–680 (mmHg) is preferable during vacuum-packing. An upper limit of this range can be set so as to be high enough to generate the capillary phenomenon, and a lower limit is determined so as to be low enough to only make the extra juice substantially transuding from the meat. This concrete preferable range can be expected to realize various effects such as prevention of propagation of general active bacteria or germs caused by the extra juice, prevention of dislocation of the liquid absorbing insert 19 and the meat 11, and effective absorption of the extra juice.

When the meat is vacuum-packed in the above method and kept at 3°–6° C., namely chilled, while not being frozen, the juice can be absorbed by the insert without being frozen. Moreover, the low temperature can be expected to decrease propagation of the generally active bacteria.

The package of the present invention comprises at least the gas impermeable film 15 for vacuum-packing the meat 11, and the liquid absorbing insert 19.

The gas impermeable film 15 has various characteristics such as gas impermeability, strength, and flexibility which can realize the vacuum-packing of the meat, and is made of materials which do not result in a bad influence on human bodies. More concretely, conventionally used polyester film and polypropylene film of 40 (μm) thickness would be preferable.

The liquid absorbing insert 19 is formed by having the absorber 16 between the liquid permeable layer 17 and the liquid impermeable sheet 18.

The liquid permeable layer 17 has, in addition to water permeability and water resistance, such density (porosity diameters) so that the absorber 16 does not come out therethrough, and its materials which do not have an influence on human bodies are desirable as well as the above gas impermeable film 15. As examples of the liquid permeable sheet, preferable are wet laid nonwoven fabric, spunbonded nonwoven fabric, paper having hydrophilic property, and others which have such strength and elongation as a sheet shape of the liquid absorber 19 can be maintained as it is. The liquid permeable layer 17 can be formed in multiple layers (not shown) so as to ensure the heat sealing property of the liquid absorbing insert 19.

The liquid impermeable sheet 18 is made of materials which are impermeable to liquid, and have water resistance, and have no bad influence on human bodies as a food packing container. For example, a polypropylene film of about 25 (μm) thickness or a double layer film of about 30 (μm) thickness formed of a polypropylene film and a polyethylene film or the like are preferably used.

These liquid permeable and impermeable sheets 17 and 18 can be laminated on each other so as to have the absorber 16 therebetween, and both the above sheets can be bonded to each other by means of an adhesive made of hydrophobic synthetic resin or by means of fusion by heat.

The absorber 16 must be formed of materials which have a function of absorbing the extra juice and have no bad influence on human bodies in case of storing the meat. For example, desirable is a water absorptive polymer sheet in which pulp or the like are added to absorptive polymer powder. Moreover, a film, nonwoven fabric, and a mesh sheet, which all include a water absorptive polymer, can be also used as the absorber 16. As the water absorptive polymer, preferable are the cross linked polyacrylic salts, starch-acrylonitrile graft polymers, vinyl acetate-acrylic salt copolymers, isobutylene-maleic anhydride copolymer, polyvinyl alcohol (PVA)-maleic anhydride copolymers, carboxymethyl cellulose (CMC) cross linking material, and so on, on 50–1,000 multiplication due to water absorptivity.

Moreover, as shown in FIG. 2, when pulp sheets 20 are provided on both surfaces of the absorber 16 which comprises a film, nonwoven fabric, or a mesh sheet, all including a high water absorptive polymer, the sheet shape of the absorber 16 can be more readily maintained and it can be expected that absorption of the extra juice is evenly performed all over the surfaces of the absorber 16.

The insert 19 can also be formed by having only the aforementioned water absorptive polymer powder, as the absorber 16, held and filled between the liquid permeable layer 17 and the liquid impermeable sheet 18.

Embodiments according to this invention have been explained in details so far and it is obvious that this invention is not limited to these embodiments. For example, one liquid absorbing insert is pressed on one piece of meat in these embodiments, but plural liquid absorbing inserts can be also pressed on one meat.

It is also obvious that numeral conditions, arrangement conditions, shapes, and other conditions can be optionally and preferably modified and deformed in design within the scope defined in the appended claims or explained in details so far, it is obvious that this invention is not limited to these embodiments.

As it is apparent from the above explanation, according to a method for packing meat set forth, the liquid absorber is arranged so as to make the liquid impermeable sheet facing meat, so that juice inside the meat will not be absorbed. Moreover, the meat and the liquid absorber are vacuum-packed in the gas impermeable film, so that the aforementioned capillary phenomenon can be utilized to carry the transuding extra juice to the liquid permeable sheet and to have it absorbed into the liquid absorber.

Accordingly, the deterioration of commodity value of the meat and the lowering of commodity profit rate of the meat due to discoloration can be prevented by avoiding contact between the extra juice and the surface of the meat. The liquid absorbing insert is pressed against the gas impermeable film because of volume increase of the insert due to swelling, so that the extra juice absorbed by this insert is expected to be prevented. Especially, even when temporal or continuous pressure is applied, return of the extra juice via the liquid permeable sheet can be lowered because this kind of pressure and the above pressure due to the volume increase corresponds to each other.

According to a method for storing meat herein set forth, when the vacuum-packed meat is chilled while applying the technique stated herein, various technical problems such as the aforementioned deterioration of commodity value, decrease of commodity profit rate, and overabsorption can be solved with removal of the extra juice from the meat.

Accordingly, in the package cf the invention, the liquid impermeable sheet of the liquid absorber is arranged so as to face the meat, and the liquid permeable sheet of the liquid absorber is arranged so as to face the gas impermeable film, whereby the extra juice is absorbed by the liquid absorbing layer indirectly by means of capillary phenomenon. The package is preferable for use in the above packing method and the stabilization of commodity quality and of commodity profit rate and the prevention of juice overabsorption can be realized.

What is claimed is:

1. A method for packaging meat to absorb excessive meat juices along the sides of the package and retain freshness which comprises providing a liquid absorbing insert formed by a water absorbing material between a sheet of a liquid impermeable material and a layer of a liquid permeable material, placing said meat so as to face said liquid impermeable sheet and prevent excessive absorption of meat juices, wrapping a gas impermeable sheet about said meat and liquid absorbing insert, and then providing a vacuum so as to form capillaries along the side of the package and provide a capillary action at spaces between the meat and the liquid permeable sheet, whereby surplus juices pass away from the meat through said capillaries to said liquid permeable material.

2. The method of claim 1 wherein said vacuum provided is about 450 to 680 mmHg.

3. The method of claim 1 wherein said sheet of liquid impermeable material comprises polypropylene.

4. The method of claim 1 wherein said liquid permeable layer is water resistant and selected from the group consisting of wet-laid non-woven fabric, spun bonded non-woven fabric and hydrophilic paper.

5. The method of claim 1 wherein said water absorbing material comprises a water absorptive polymer.

6. The method of claim 5 wherein said water absorptive polymer is selected from the group consisting of cross-linked polyacrylic salt, starch-acrylonitrile graft polymer, vinyl acetate-acrylic salt copolymer, isobutylene-maleic anhydride copolymer, polyvinyl alcohol-maleic anhydride copolymer and cross-linked carboxymethylcellulose.

7. The method of claim 1 including refrigerating the resulting product.

8. The method of claim 1 wherein a vacuum of about 450 to 680 mm Hg is applied to create the capillaries.

* * * * *